US006217241B1

(12) United States Patent
Kobayashi

(10) Patent No.: US 6,217,241 B1
(45) Date of Patent: Apr. 17, 2001

(54) MULTIPLEX WRITING IMPLEMENT

(75) Inventor: Seiichi Kobayashi, Yokohama (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/302,722

(22) Filed: Apr. 30, 1999

(51) Int. Cl.[7] ..... B43K 24/10; B43K 27/00

(52) U.S. Cl. ..... 401/32; 401/29; 401/195; 401/209

(58) Field of Search ..... 401/29, 31, 32, 401/33, 192, 209, 219

(56) References Cited

U.S. PATENT DOCUMENTS

| | | | | |
|---|---|---|---|---|
| 1,528,687 | * | 3/1925 | Nyman et al. | 401/31 |
| 2,704,532 | * | 3/1955 | Musser | 401/192 |
| 3,225,747 | * | 12/1965 | Schmidt | 401/33 |
| 5,026,190 | * | 6/1991 | Longarzo | 401/32 |
| 5,599,122 | * | 2/1997 | Yu | 401/31 |
| 5,899,618 | * | 4/1999 | Kobayashi et al. | 401/29 |
| 5,929,135 | * | 7/1999 | Wasai et al. | 401/209 |
| 5,993,098 | * | 11/1999 | Osada | 401/216 |

FOREIGN PATENT DOCUMENTS

| | | | | |
|---|---|---|---|---|
| 1224178 | * | 9/1966 | (DE) | 401/33 |
| 2552975 | * | 6/1977 | (DE) | 401/29 |
| 855338 | * | 5/1940 | (FR) | 401/31 |
| 51255 | * | 2/1942 | (FR) | 401/31 |

* cited by examiner

*Primary Examiner*—Charles R. Eloshway
(74) *Attorney, Agent, or Firm*—Darby & Darby

(57) ABSTRACT

A multiplex writing implement has a multiple number of ball-point pen elements in the barrel cylinder thereof, in which an ink reservoir thereof is filled with a water based ink having so-called thixotropy, which is a characteristic which lowers the viscosity of ink as the tip ball rolls, allowing outflow of ink, or a low-viscosity oil based ink and which are configured so that their writing tips can selectively move in and out through the front end opening of a mouthpiece of the barrel cylinder, and is constructed such that at least the front part of the barrel cylinder is formed of a transparent resin molding and the mouthpiece which is opaque and tapered toward the front end is attached to the front of the barrel cylinder.

13 Claims, 12 Drawing Sheets

MULTIPLEX WRITING IMPLEMENT

BACKGROUND OF THE INVENTION

1. Field of the Invention

The present invention relates to an improvement of a multiplex writing implement having a plurality of ball-point pen elements.

2. Description of the Prior Art

In general, there are known multiplex writing implements of rotary, clicking and slider types and the like, which have a plurality of writing elements such as a mechanical pencil, ball-point pen and the like, and selectively allow one of the writing tips to move in and out through the front end thereof.

Meanwhile, conventionally known oil based ball-point pens use an ink having a high viscosity of some thousands of mPa·S or more, hence a considerably large resistance arises when the ball rolls and the ink flows out from the writing point, producing an uncomfortable writing sensation. Further, the pen of this type suffers from problems in that a lesser amount of ink can flow from the writing point during writing and in that blobbing, hence lines drawn can be irregular in parts, the density of the written trace is light and a strong pressure for writing is needed.

As an improvement of the oil based ball-point pen, there has been recently developed a ball-point pen for water based ink which uses an ink having an intermediate viscosity between viscosity of the above water based type and that of the oil based type (ranging from a few mPa·S to some thousands of mPa·S) and hence is called a medium viscosity ink. This ball-point pen uses water based ink having a relatively low viscosity which has so-called thixotropy, that is, a characteristic which lowers the viscosity of ink as the tip ball rolls, so that the ink can smoothly flow out.

As an improvement of oil based ball-point pens, it is possible to consider a ball-point pen which uses an oil based ink having both a low viscosity and an excellent drought resistance.

Because of the less viscosity of ink, any of the above ball-point pens using medium viscosity water based ink or low viscosity oil based ink markedly suffers from the forward leakage problem of ink oozing out from a gap, if any, between the ball point and the tip holder when it is held with its pen tip down, and also suffers from the problem of ink leaking backward when the pen is used with its tip upward or when it receives impacts and the like. When backward or forward leakage of ink occurs, there is a risk of the ink staining clothes and the like. Further, if, while the tip ball and the ball-holder in the point assembly remain in contact with the tapering inner surface of the mouthpiece, the writing tips are made to move in and out repeatedly through the front end opening of the mouthpiece, the inner surface of the mouthpiece is stained with ink, degrading its appearance.

Liquid applicators using a white pigment for correcting character errors etc., are known.

Because the white pigment readily separates from its solvent, applicators of this kind are formed of a flexible container with the ink, a ball, etc. confined therein and the ink and solvent need to be mixed by shaking when it is used. Also the container needs to be pressed on its side part to eject the ink. However, when a reduced amount of ink remains, ink will not be ejected even with strong pressure acting on the side wall of the container, causing user irritation. Further, in order to avoid the applicator's tip drying, the tip is adapted to be sealed with a cap.

SUMMARY OF THE INVENTION

It is therefore an object of the present invention to configure a medium viscous, water based or low viscous, oil based ball-point pen element which can maintain its drought resistance of the writing tip and can be left with its sealing cap off, and provide a mechanism for preventing forward and backward ink leakage, in which a plurality of such ball-point pen elements are accommodated in the barrel cylinder so that the writing tips can move in and out smoothly through the front end opening of the mouthpiece. Further, the invention enables the types of the ball-point pen elements to be viewed from outside of the barrel cylinder, and makes it possible to solve the problem of bad appearance, i.e., the problem of the tip ball and tip-ball holder touching the tapering inner surface of the mouthpiece and hence staining the inner surface with ink when the writing tips move in and out through the front end opening of the mouthpiece. Also, the invention makes it further possible to avoid the problem, that is, inducement of ink forward leakage and stain of the inner surface and damage of the ball holder causing degradation of writing performance, all attributed to contact of the tip ball and the ball holder of the point assembly with the inner surface.

Further, the invention makes it possible to provide a convenient multiplex writing implement of which at least one of the ball-point pen elements is an ball-point pen for mistake correction which needs no agitation and is free from the botheration of pressing the container side part.

In order to attain the above objects, the present invention is configured as follows:

The first aspect of the invention resides in a multiplex writing implement having a plurality of ball-point pen elements in the barrel cylinder thereof, in which an ink reservoir thereof is filled with a water based ink having so-called thixotropy, which is a characteristic which lowers the viscosity of ink as the tip ball rolls, allowing outflow of ink, or a low-viscosity oil based ink and which are configured so that the writing tips thereof can selectively move in and out through the front end opening of a mouthpiece of the barrel cylinder, characterized in that at least the front part of the barrel cylinder is formed of a transparent resin molding and the mouthpiece which is opaque and tapered toward the front end is attached to the front of the barrel cylinder.

The second aspect of the invention resides in the multiplex writing implement according to the first feature, wherein longitudinal grooves are formed at required positions on the tapering inner surface of the mouthpiece and the ball holder of the point assembly is loosely inserted in the longitudinal groove when the writing tip moves in and out through the front end opening so that at least the ball holder is kept out of contact with the tapering inner surface.

The third aspect of the invention resides in the multiplex writing implement according to the first feature, wherein a joint for joining the ink reservoir and the point assembly has a projection on the peripheral surface thereof which comes in contact with the tapering inner surface in such a manner that the ball holder is kept out of contact with the tapering inner surface of the mouthpiece when the writing tip moves in and out through the front end opening of the mouthpiece.

The fourth aspect of the invention resides in the multiplex writing implement according to the first feature, wherein the ball-point pen element is configured so that the tip ball is continuously pressed into sealing contact with the inner brim of the ball holder at tip of the point assembly and a follower which is made of a nondrying greasy material and moves following the consumption of the ink as writing proceeds is added at the rear end of the ink.

The fifth aspect of the invention resides in the multiplex writing implement according to the first feature, wherein at least one of the ball-point pen elements is a ball-point pen for mistake correction and the ink is a white pigment ink which includes a white pigment such as titanium oxide, hollow high polymer micro-particles and the like and is compounded so that the pigment is prevented from settling and losing its fluidity.

The sixth aspect of the invention resides in the multiplex writing implement according to the first feature, wherein the ball-point pen element has a valve chamber in which a ball valve is loosely held therein facing the rear end of the point assembly and the rear part of the valve chamber comprises a ball seat with which the ball valve comes into sealing contact to prevent ink from flowing backward and a conduit communicating between the ball seat and the ink reservoir.

The seventh aspect of the invention resides in the multiplex writing implement according to the first feature, wherein the ball-point pen elements disposed axially movable with respect to the barrel cylinder and a mechanism for moving back and forth the ball-point pen elements in an alternating manner are provided, and the ink reservoir of the ball-point pen element is substantially non-deformable and is fitted so as not to sway within the barrel cylinder, and the joint connecting between the ink reservoir and the point assembly is formed with a deformable, flexible part.

According to the configuration of the multiplex writing implements, the types of ball-point pen elements can be viewed from outside of the barrel cylinder while it is possible to solve the problem of bad appearance, i.e., the problem of the tip ball and tip-ball holder touching the tapering inner surface of mouthpiece and hence staining the inner surface with ink when the writing tips move in and out through the front end opening of the mouthpiece. Further, it is possible to avoid the problem, that is, inducement of ink forward leakage and stain of the inner surface and damage of the ball holder causing degradation of writing performance, all attributed to contact of the tip ball and the ball holder of the point assembly with the inner surface. Further, it is possible to provide a convenient multiplex writing implement of which at least one of the ball-point pen elements is a ball-point pen for mistake correction which needs no agitation and is free from the botheration of pressing the container side part.

DESCRIPTION OF THE PREFERRED EMBODIMENTS

To begin with, FIGS. 1 through 4 show embodiment 1 of the invention.

The multiplex writing implement, intended by the invention is configured with a combination of a ball-point pen element filled with a medium viscosity water based ink having so-called thixotropy or a low-viscosity oil based ink and a ball-point pen element for mistake correction, filled with a white pigment ink having thixotropy, or any other combination as required.

Ink used in a ball-point pen element for mistake correction is a white pigment ink which contains at least a white pigment such as titanium oxide, hollow high polymer micro-particles and the like and a gelatinizer compounded so that the pigment is prevented from settling and losing its fluidity.

Here, when the ink viscosity is equal to or lower than 10,000 cps (E type viscometer, 1 rpm, 25° C.), the pigment tends to settle, whereas when the ink viscosity is equal to or greater than 50,000 cps, the ink gives rise to an outflow problem. Therefore, the viscosity of the ink is set in an intermediate range. Since this ink is in the high viscosity range but presents thixotropy in, it enables highly hiding application by virtue of a lowing viscosity as the tip ball rolls.

Next, a ball-point pen element incorporated in the multiplex writing implement of the invention will be detailed.

Figure 1:
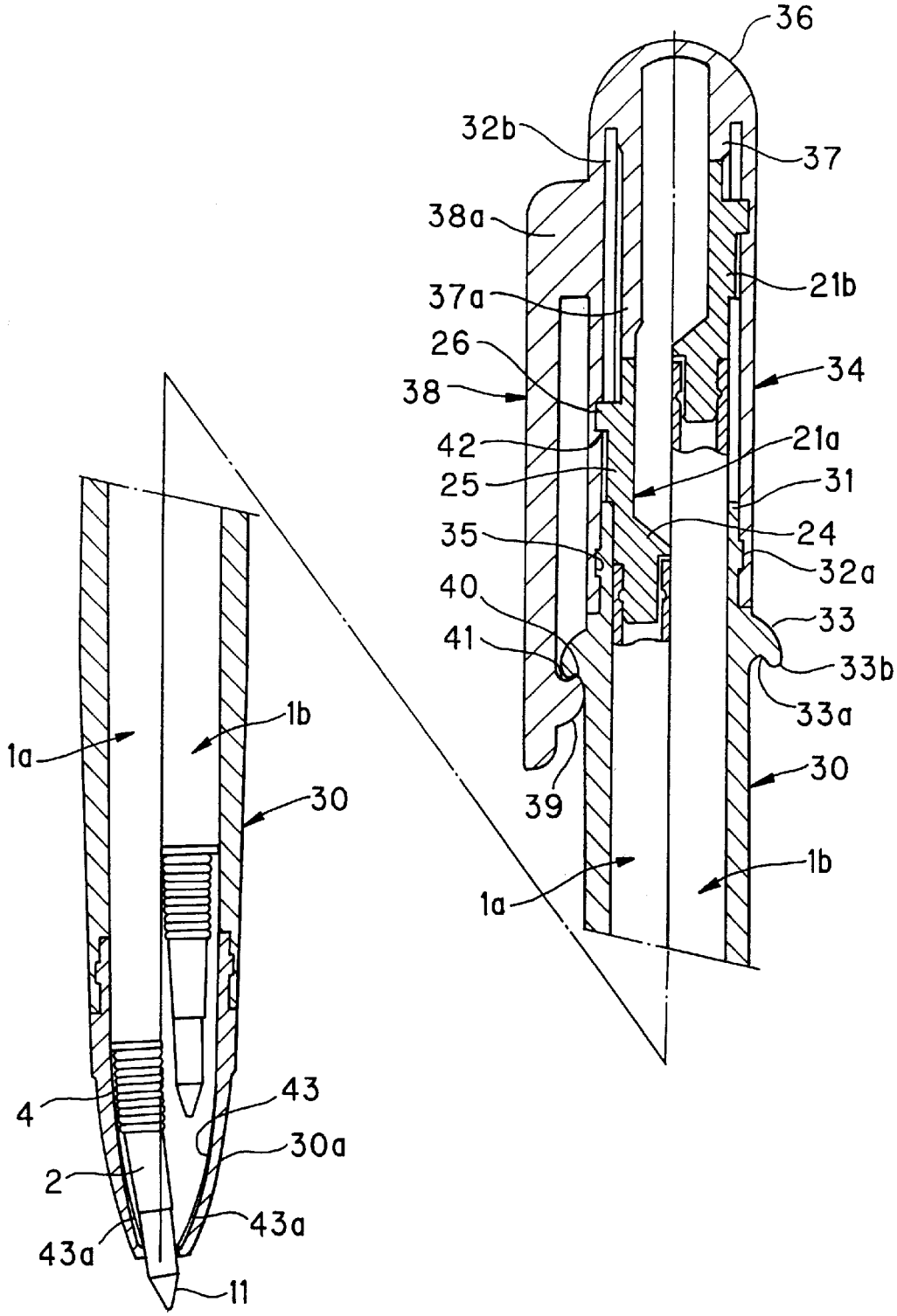
FIG. 1 is a longitudinal sectional view showing the overall configuration of a multiplex writing implement of embodiment 1 of the invention, having two types of ball-point pen elements, where a part of the view is in the non-sectional representation.

In FIG. 1, two ball-point pen elements 1*a* and 1*b* are provided.

Ball-point pen elements 1*a* and 1*b* have the same configuration, with different types of ink, for example. Here, the structure of ball-point pen element 1*a* will be illustrated.

Figure 4:
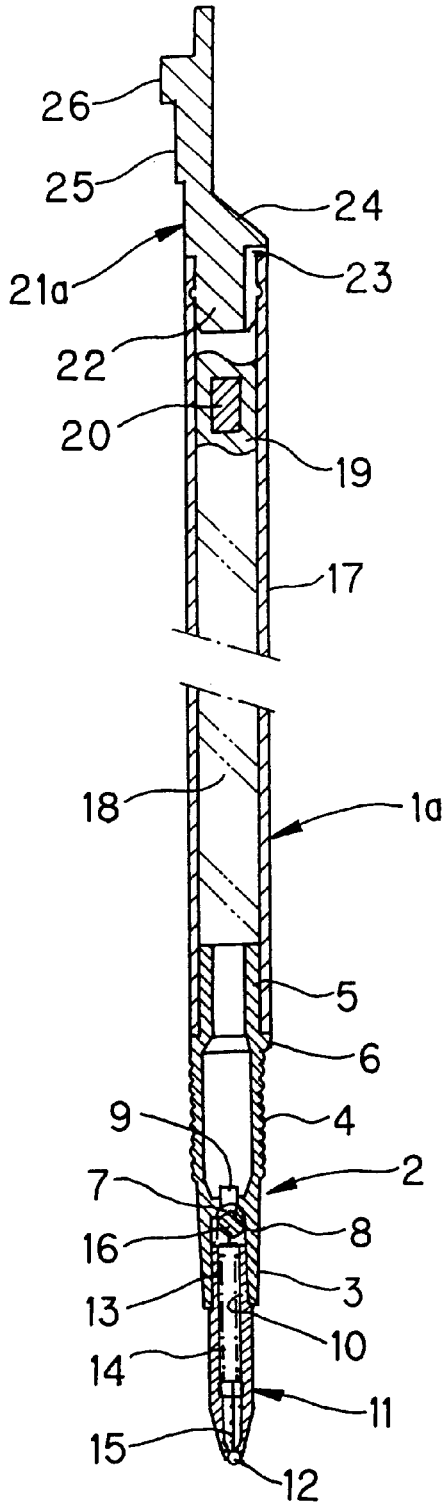
FIG. 4 is a longitudinal sectional view showing a ball-point pen element used in embodiment 1.

As shown in FIG. 4, a point assembly 11 is constructed so that a tip ball 12 is substantially abutted onto a seat having channels which will permit ink to flow in, and is held rotatably by caulking. A spring 14 is inserted into the bore of tip assembly 11. The rear end of the point assembly is appropriately caulked so that the rear end of spring 14 will not come out. In order to prevent drying of the writing tip and forward leakage of ink, it is very important to bring tip ball 12 into sealing contact with the inner surface of the ball holder of the point assembly. For this purpose, in order to improve the surface roughness of the inner surface of the point assembly that holds the tip ball and the precision of the sealing contact by caulking, the ground finish to the inner surface and the secondary plastic process for improving the accuracy of caulking should be considered. Further, the surface treatment etc. of the contact surface with the tip ball should be considered. A straight rod portion 15 is extended forwards from spring 14 with its front end abutting the rear side of tip ball 12 to urge it. This pressure causes tip ball 12 to come in sealing contact with the inner brim of the ball holder (formed by caulking or the like) of point assembly 11.

As another means for urging tip ball 12 onto the inter surface of the ball holder of point assembly 11, a member having a rod shaft portion at the front end thereof can be arranged at the front end of the coiled portion of the spring so that the rod shaft end will urge the rear side of tip ball 12.

Further, a spring seat may be provided around channels in point assembly 11 so as to press tip ball 12.

A joint piece 2 is a plastic molding which has a front pipe portion 3 at the front end thereof to which point assembly 11 is press-fitted, and a rear pipe portion 5 which is press-fitted to the front end of an ink reservoir 17, being integrated with a flexible portion 4 between front pipe portion 3 and rear pipe portion 5 to provide flexibility therebetween.

Formed inside joint 2 is a valve chamber 7 in which a ball valve 16 is placed, with play, facing the rear end of point assembly 11. When point assembly 11 is oriented downward, a conduit 9 is open so as to allow ink 18 to communicate with the point assembly side. Conversely, when the point assembly is oriented upward, ball valve 16 confines conduit 9 to prevent backward flow of ink.

Typically, the ink filling the ball-point pen element for mistake correction has a high viscosity as stated above. Since it is necessary for such ink to flow in an increased amount, the backwards movement of the tip ball when a writing pressure is applied is set greater compared to a typical ball-point pen element for writing. Accordingly, the problem of drying at the writing tip and the ink forward leakage problem cannot be ignored. Further, though the ball valve is not always necessary because the tip ball is pressed against the inner surface of the ball holder of the point assembly, the ink reservoir needs a greater sectional size because of the imperfection of the sealing or an increased consumption of ink, hence the problem of backward leakage of ink also cannot be ignored when considering upward writing and impacts.

Also, ink reservoir 17 has an approximately D-shaped cross-section (not shown) so that a pair of writing elements can be incorporated compactly in the inner bore space of an aftermentioned barrel cylinder 30 with their flat portions opposing each other forming an approximately circular section. If there are three writing elements, the ink reservoir has an approximately fan-shaped cross-section formed by dividing a circle into parts each having an angle of 120 degree. Ink reservoir 17 is filled up with an ink, water based having the medium viscosity, oil based or the like, stated above. Further, an ink follower 19 consisting of a translucent, nondrying greasy material is added to the ink rear end. This follower will move in contact with the ink surface following the consumption of the ink. A resin-made follower rod 20 having a specific weight substantially equal to that of follower 19 is immersed in the follower.

Press-fitted into the rear bore of ink reservoir 17 is a front plug 22 in the front part of a slider piece 21*a*. A vent channel allowing for communication between the interior of ink reservoir 17 and the outside air is formed on the peripheral surface of plug 22.

A rear shank portion 24 in the rear part of slider piece 21*a* has a guide rib 25 on one side thereof with a slider projection 26 which projects appropriately from the outer surface of guide rib 25. Thus, ball-point pen element 1*a* is configured. Ball-point pen element 1*b* is also configured in the same manner.

As another method of configuring a ball-point pen element, it is possible to form the joint and ink reservoir with an integral resin molding. The flexible portion may be formed either together with the joint portion or at the front part of the ink reservoir.

Next, the multiplex writing implement shown in FIG. 1 is composed of two types of ball-point pen elements, a barrel cylinder 30 accommodating the ball-point pen elements and an actuator 34 attached in the rear of barrel cylinder 30 so as to move only in a rotational direction. Actuator 34 can be detached from barrel cylinder 30, as required, for exchange of the writing elements or for other reasons. The multiplex writing implement of the invention can be applied also to clicking type or slider type or the like configurations, other than the structure shown in the embodiment.

Figure 2:
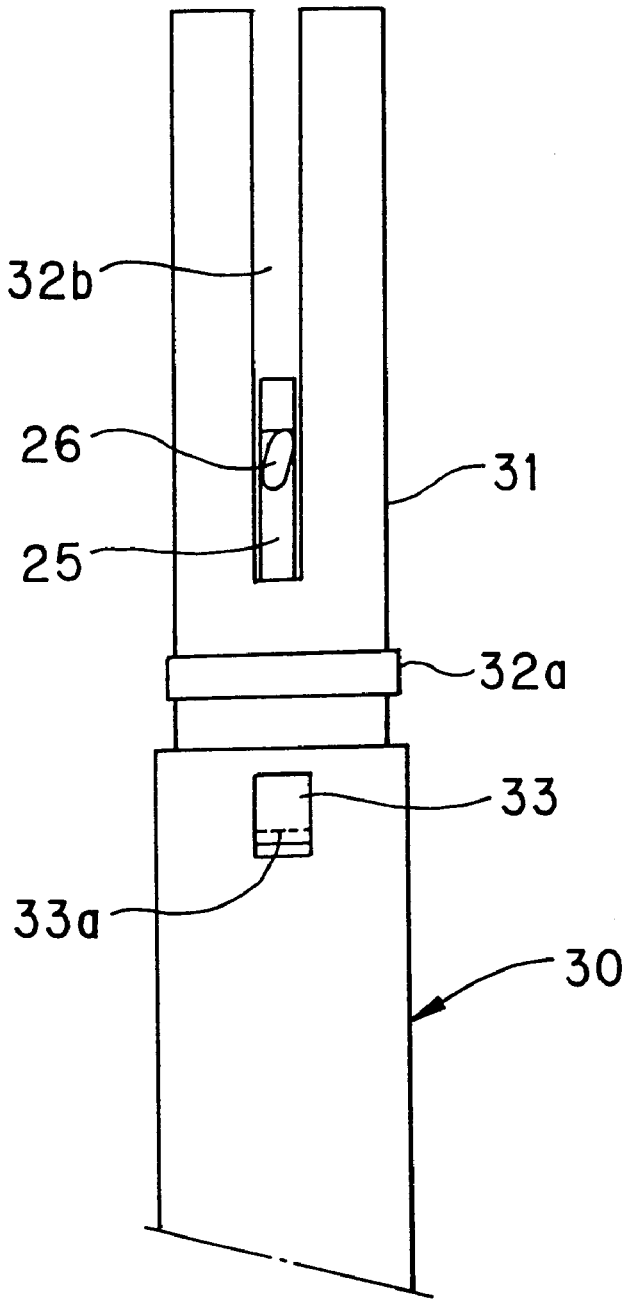
FIG. 2 is an outside view showing essential parts of the rear portion of a barrel cylinder.

A pair of bulges 33 are formed on the outside periphery at positions closer to the rear end of barrel cylinder 30. Each bulge 33 has an engaging portion of a projection 33*b* and a recess 33*a* on the front side thereof. As shown in FIGS. 1 and 2, a sleeve 31 is extended rearwards from bulges 33 and formed with annular projection 32*a* on the peripheral surface of sleeve 31 and to more rearwards a pair of slits 32*b* opening to the rear end. In this arrangement, the above-described ball-point pen elements 1*a* and 1*b* are fitted into barrel cylinder 30 with guide ribs 25 and slider projections 26 of slider pieces 21*a* and 21*b* provided at the rear end of ball-point pen elements 1*a* and 1*b* fitted in respective slits 32*b*.

Barrel cylinder 30 is a transparent molding integrated with an opaque mouthpiece 30*a* which is tapered in the direction of the front end toward the tip. Mouthpiece 30*a* may be produced by double-forming or integral forming with barrel cylinder 30 and then painting opaquely and the like.

Alternatively, the mouthpiece may be formed as a separate member and joined to the barrel cylinder by press-fitting or the like.

Further, longitudinal grooves 43*a* having an appropriate depth are formed at appropriate positions in the tapering inner surface 43 of mouthpiece 30*a* and along the tapering inner surface. Longitudinal grooves 43*a* are of a width which loosely fits the ball holder of the point assembly keeping it out of contact.

Figure 3:
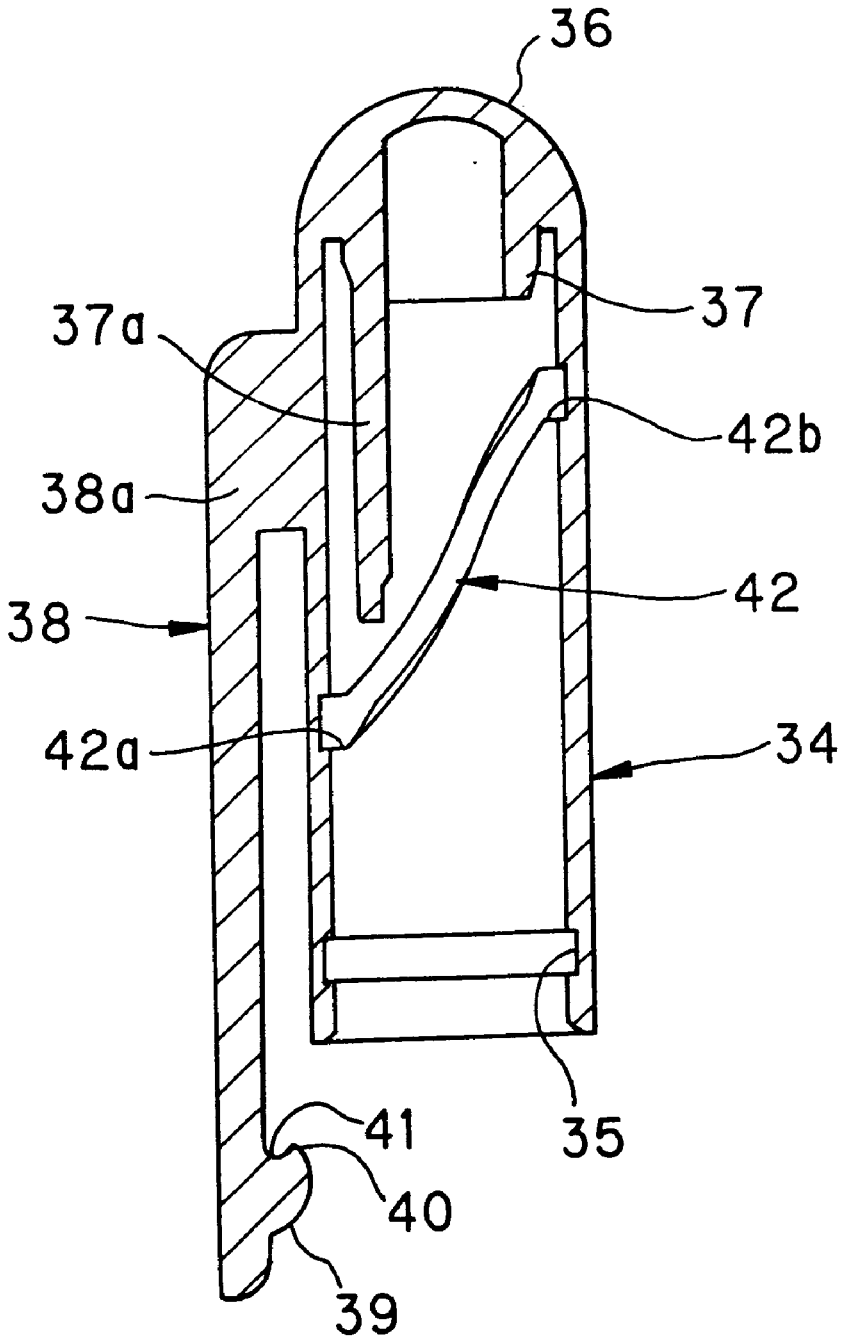
FIG. 3 is a sectional view of an actuator.

As shown in FIG. 3, actuator 34 is a cylindrical body having a crown 36 capping the rear end, and a clip 38 extending forwards is joined at its proximal end 38*a* on the rear, outside peripheral part of the cylindrical body. Clip 38 has a bead 39, which has a projection 40 and a recess 41 on its rear side forming an engaging portion. The circular movement, described later, of the clip with the rotation of actuator 34, causes projection 40 of bead 39 to engage and disengage recess 33*a* (FIGS. 1 and 2) of bulge 33.

Actuator 34 has an annular groove 35 formed in the front, inner periphery thereof and helical grooves 42 formed in the rear, inner periphery thereof. Formed at the front and rear ends of helical grooves 42 are horizontal grooves 42*a* and 42*b* as appropriate. An annular rib 37 extending from crown 36 is formed to the rear of helical grooves 42. Further, a rib 37*a* extends forwards from one end of annular rib 37.

Thus configured actuator 34 is fitted to sleeve 31 of the barrel cylinder, and groove 35 engages projection 32*a* by elastic deformation so that the actuator will rotate but not slip off with respect to barrel cylinder 30. In this case, slider projections 26 of the above slider pieces 21*a* and 21*b* are engaged with corresponding helical grooves 42 by elastic deformation, so that ball-point pen elements 1*a* and 1*b* alternately move back and forth and hence the writing tips move in and out through the front end opening of the barrel cylinder as actuator 34 is rotated relative to barrel cylinder 30. When one of the ball-point pen elements is projected, the front end of rib 37*a* abuts and engages the rear end of the slider piece of the projected element. Here, the aforementioned horizontal grooves 42*a* and 42*b* are provided in order to halt the longitudinal movement of the ball-point element as the rib 37*a* becomes engaged with or disengaged from the slider piece as actuator 34 rotates relative to barrel cylinder 30. As stated already, ink reservoir 17 is non-deformable, but the writing tip can move in and out smoothly by virtue of flexible portion 4. Joint 2 of each ball-point element has a projection 3*a* or 3*b* (see FIG. 6), and the tip-ball holder of the writing tip is kept out of contact with inner surface 43, which is tapered toward the barrel front, thus it is possible to avoid stain from ink and damage to the tip-ball holders.

In the embodiment of the above writing element, each ball-point pen element is adapted to have flexible portion 4 in its front part and has a D-shaped cross section in its ink reservoir. These facts are effective in keeping the barrel cylinder as thin as possible. However, if the thickness of the barrel cylinder is not important, the ball-point pen element can have no flexible portion 4 and the ink reservoir may have a normal, circular cross section. When the barrel cylinder is formed so as to have a rectangular cross-section with two types of ball-point pen elements arranged across the long side so that the pen can be gripped across the short side during writing, it is possible to provide a configuration which is almost satisfactory in use without providing any flexible portion 4 in the ball-point pen elements while each ink reservoir can have a normal, circular cross section.

Figure 5:
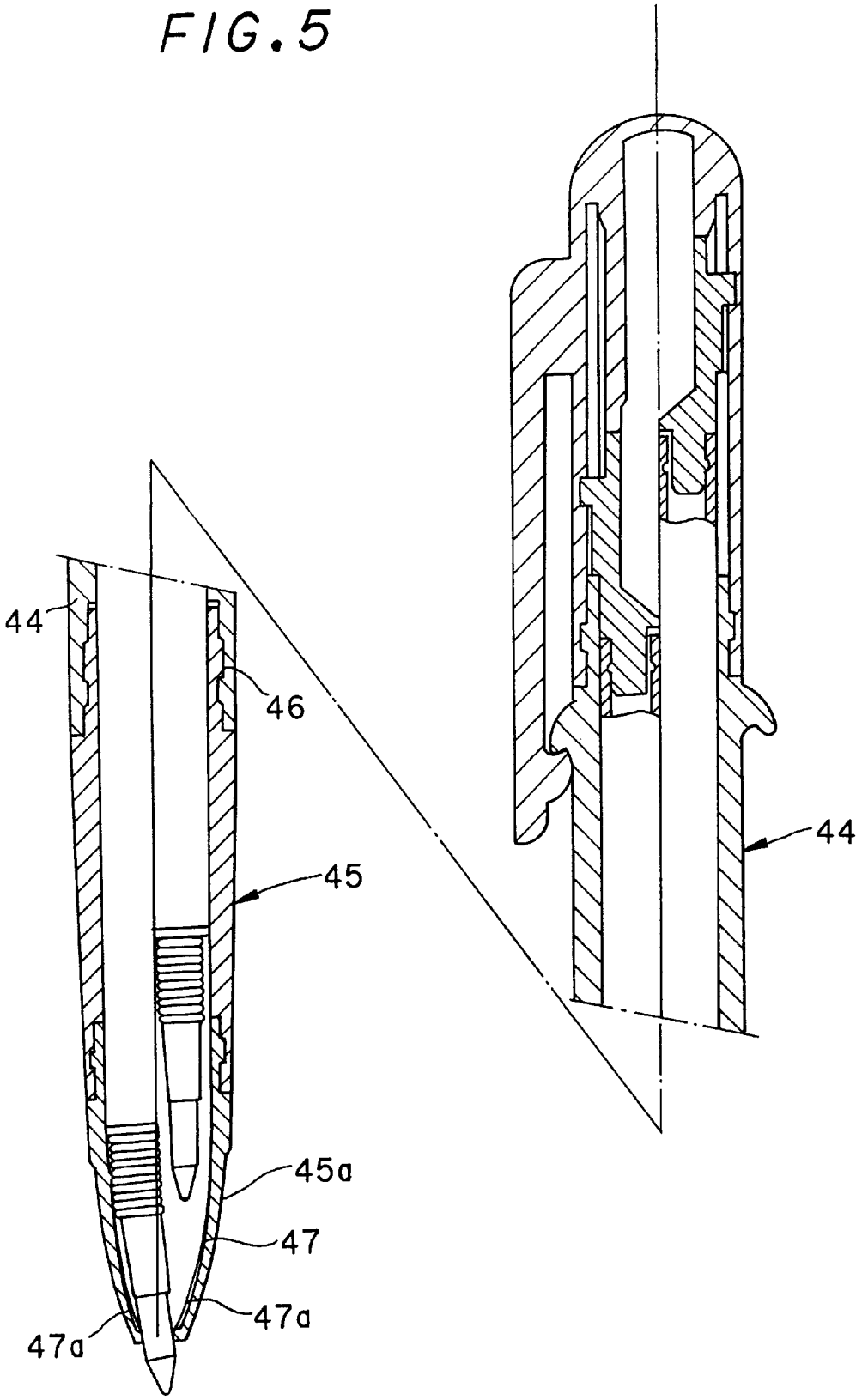
FIG. 5 is a longitudinal sectional view showing the overall configuration of a multiplex writing implement of embodiment 2 of the invention, having two types of ball-point pen elements, where a part of the view is in the non-sectional representation.

FIG. 5 shows embodiment 2 of the invention, in which the slider piece at the rear end of the ball-point pen element is formed detachable from the ink reservoir while the part in front of a barrel cylinder 44 is formed as a front barrel 45 which is detachable from the barrel to allow for replacement of the ball-point pen elements.

Here, in order to make the writing tips correspond to longitudinal grooves 47*a* formed along the tapering inner surface 47 of mouthpiece 30*a*, barrel cylinder 44 and front barrel 45 are configured so as to be positioned and detachable with respect to the other by an engaging portion 46 which is formed of a combination of ribs and projections. Other configurations are the same as embodiment 1.

Figure 6:
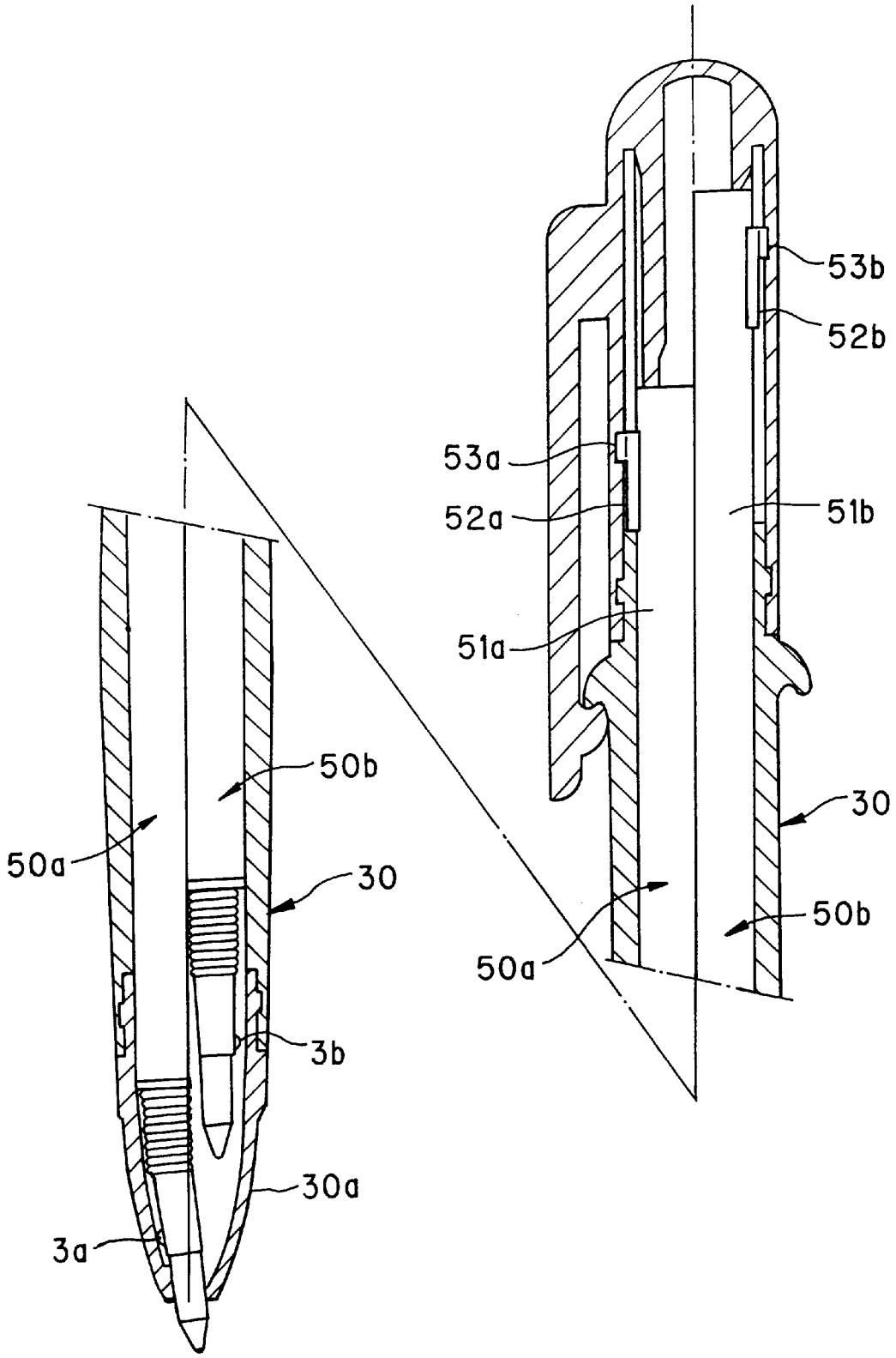
FIG. 6 is a longitudinal sectional view showing the overall configuration of a multiplex writing implement of embodiment 3 of the invention, having two types of ball-point pen elements, where a part of the view is in the non-sectional representation.
Figure 7:
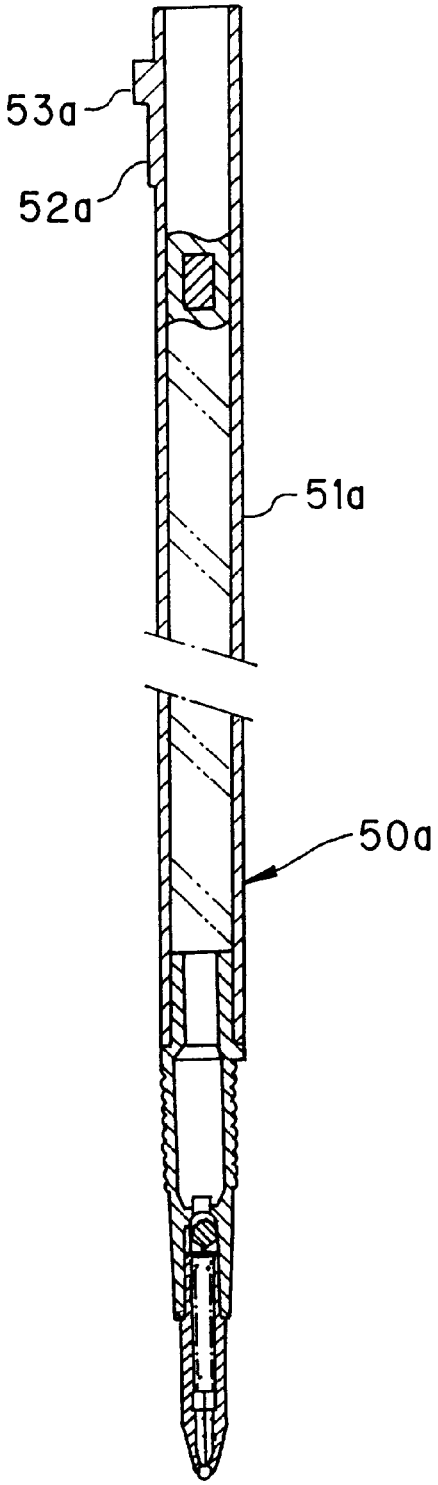
FIG. 7 is a longitudinal sectional view showing a ball-point pen element used in embodiment 3.

FIGS. 6 and 7 show embodiment 3 of the invention. In FIG. 6, a pair of ball-point pen elements 50*a* and 50*b* are provided.

Embodiment 3 is almost the same as embodiment 1, except the configuration of the ball-point pen elements.

Also, ball-point pen elements 50*a* and 50*b* basically have the same configuration as ball-point pen elements 1*a* and 1*b* of embodiment 1. Now, the difference will be explained.

First, in FIG. 7, a guide rib 52*a* is integrally formed in the rear outside peripheral part of an ink reservoir 51*a* while a slider projection 53*a* is formed so as to project from the outer surface of guide rib 52*a* as appropriate. Ball-point pen element 50*b* also has the same configuration.

Figure 8:
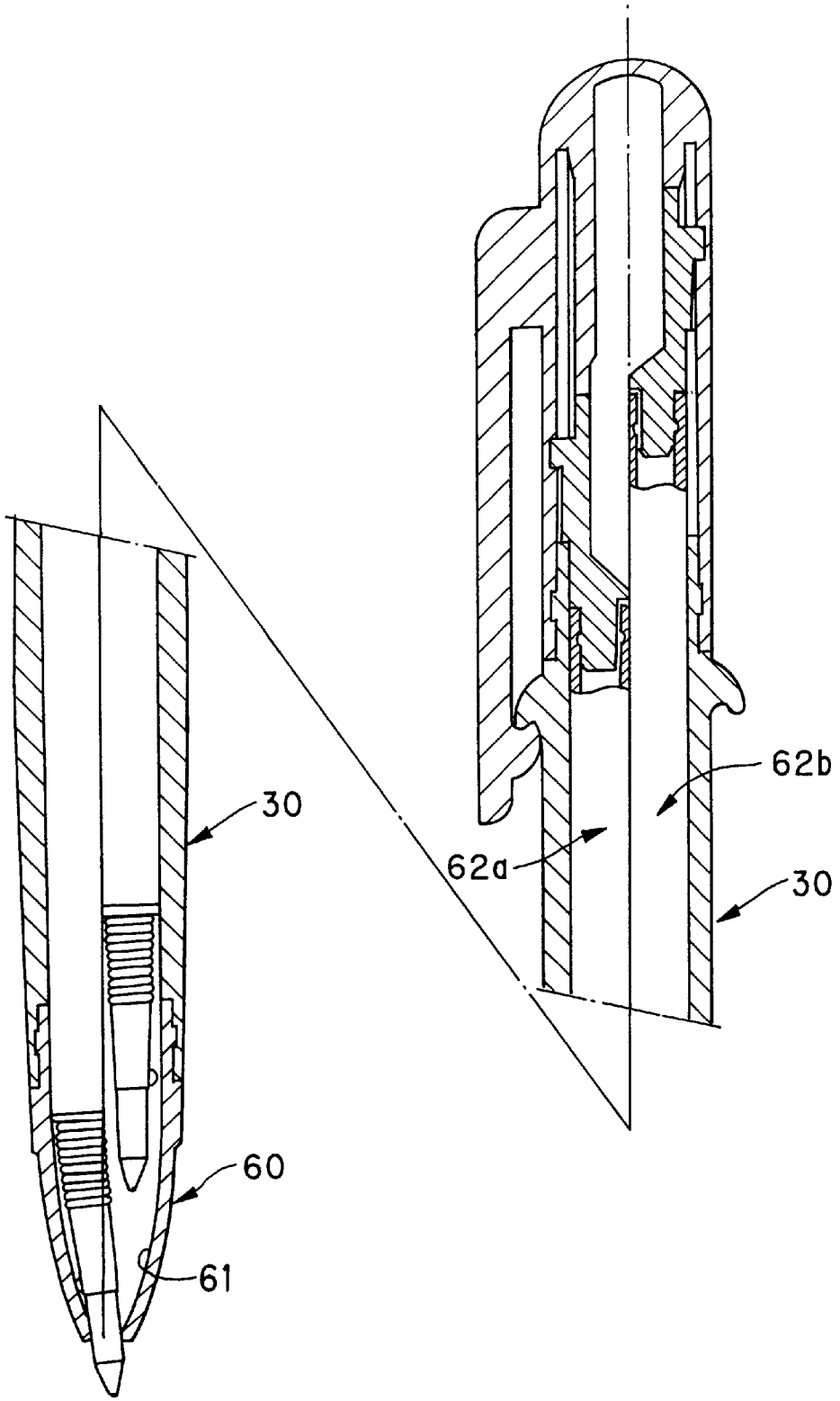
FIG. 8 is a longitudinal sectional view showing the overall configuration of a multiplex writing implement of embodiment 4 of the invention, having two types of ball-point pen elements, where a part of the view is in the non-sectional representation.
Figure 9:
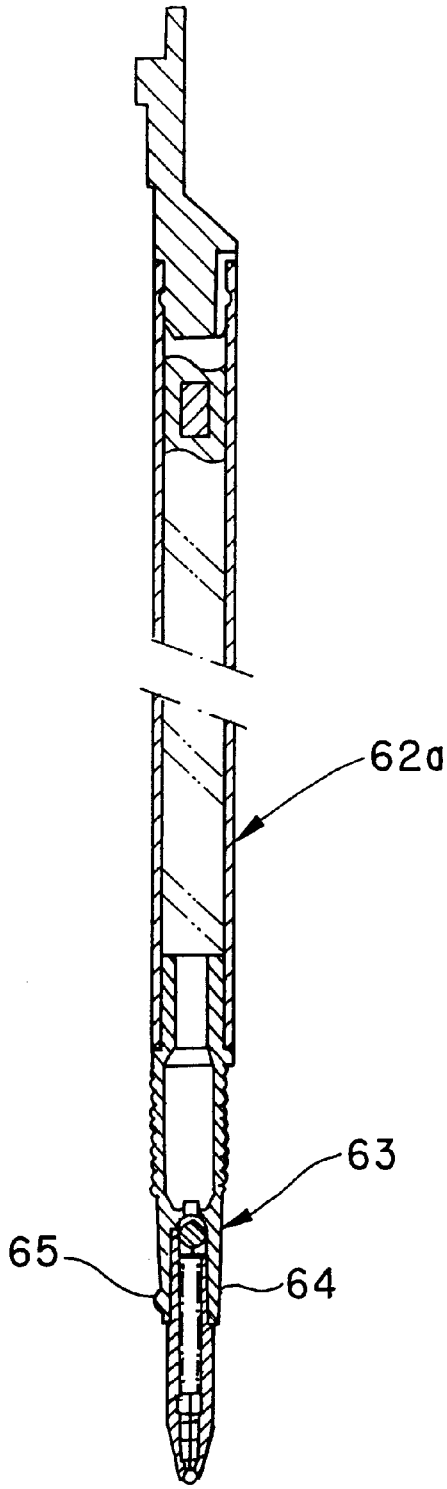
FIG. 9 is a longitudinal sectional view showing a ball-point pen element used in embodiment 4.

FIGS. 8 and 9 show embodiment 4 of the invention. In FIG. 8, a pair of ball-point pen elements 62*a* and 62*b* are provided.

Embodiment 4 is almost the same as embodiment 1, other than the differences described hereinbelow.

First, barrel cylinder 30 is a transparent resin molding integrated at its front end thereof with an opaque mouthpiece 60 which is tapered toward the front.

Ball-point pen elements 62*a* and 62*b* basically have the same configuration as ball-point pen elements 1*a* and 1*b* of embodiment 1. The difference is that a projection 65 is formed on the peripheral surface of a front pipe portion 64 of a joint 63 as shown in FIG. 9 and the projection 65 keeps the ball-holder of the point assembly out of contact with a tapering inner surface 61 of a mouthpiece 60, to thereby avoid ink stain and damage to the ball-holder of the point assembly.

Figure 10:
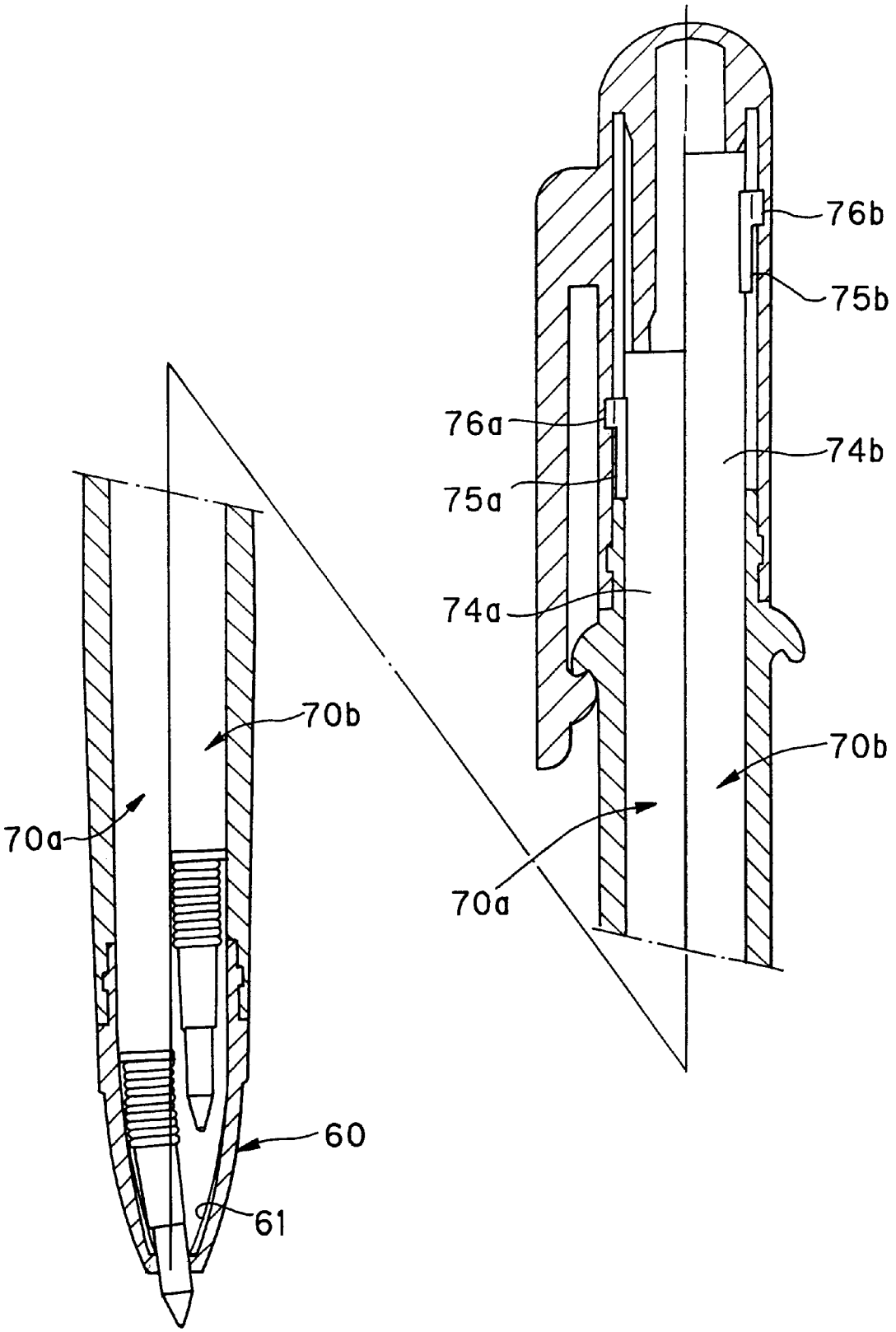
FIG. 10 is a longitudinal sectional view showing the overall configuration of a multiplex writing implement of embodiment 5 of the invention, having two types of ball-point pen elements, where a part of the view is in the non-sectional representation.
Figure 11:
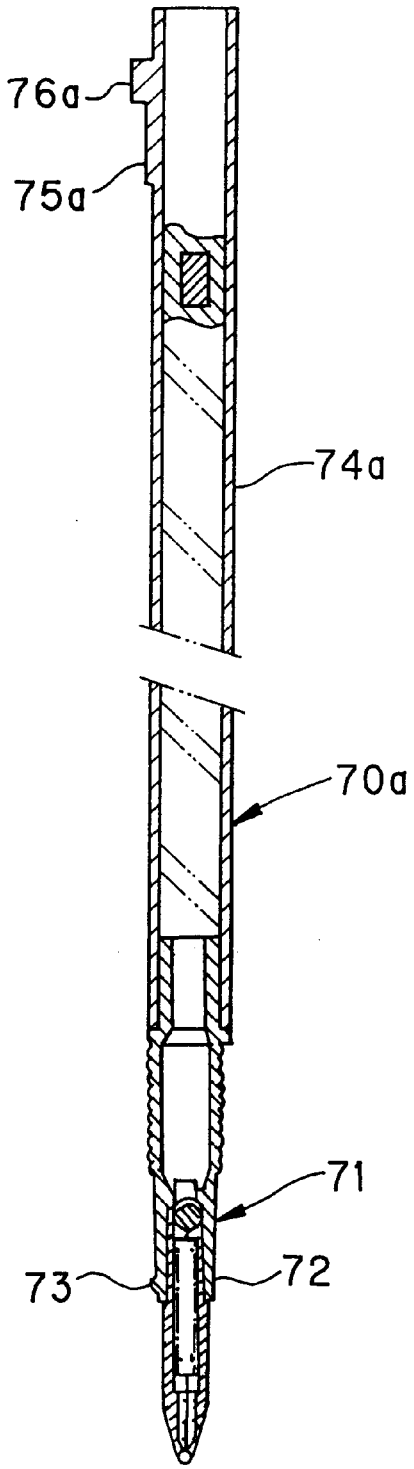
FIG. 11 is a longitudinal sectional view showing a ball-point pen element used in embodiment 5.

FIGS. 10 and 11 show embodiment 5 of the invention. In FIG. 10, a pair of ball-point pen elements 70*a* and 70*b* are provided.

Embodiment 5 is almost the same as embodiment 4, other than the differences described hereinbelow.

First, in ball-point pen element 70*a*, a guide rib 75*a* is integrally formed in the rear outside peripheral part of an ink reservoir 74*a* while a slider projection 76*a* is formed so as to project from the outer surface of guide rib 75*a* as appropriate. Ball-point pen element 70*b* also has the same configuration.

Figure 12:
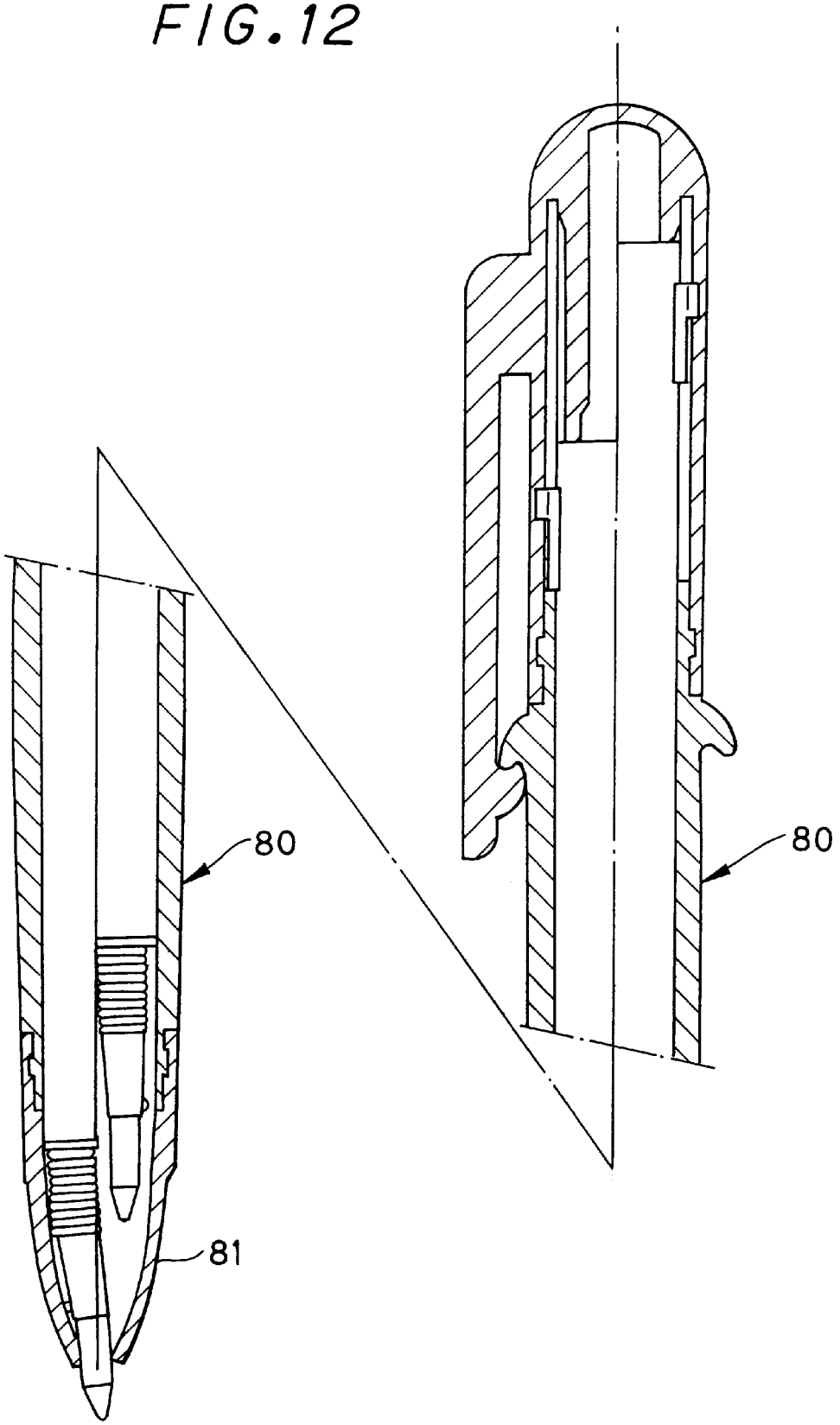
FIG. 12 is a longitudinal sectional view showing the overall configuration of a multiplex writing implement of embodiment 6 of the invention, having two types of ball-point pen elements, where a part of the view is in the non-sectional representation.

Further, FIG. 12 shows embodiment 6 of the invention. This embodiment has almost the same configuration as embodiment 5, except in that the internal and external relationship of the joining portion where the front end of a barrel cylinder 80 and the rear end of a mouthpiece 81 are joined is changed.

(Operation)

As actuator 34 rotates in one direction relative to barrel cylinder 30, slider projections 26 of slider pieces 21*a* and 21*b* move along helical grooves 42, one moving forward, the other moving backward so that the writing tip of the writing element moving forward can come out from the front end opening of the mouthpiece 30*a*. Since the front part of the writing element moves flexibly even while the ink reservoir of the ball-point pen element is non-deformable, the writing tip can move in and out smoothly through the front end opening without being impeded.

Since barrel cylinder 30 is transparent, the type and the ink condition of ball-point pen element can be seen. Since mouthpiece 30*a* is opaque, the ink smudges are hidden, giving a beneficial appearance.

When the writing tips move in and out through the front end opening of the mouthpiece as stated above, the ball holder of point assembly 11 will not come in contact with tapering inner surface 43 of mouthpiece 30*a*, so it is possible to avoid inducement of ink forward leakage and stain on the inner surface as well as damage to the ball holder of point assembly 11.

When one ball-point pen element 1*a* is projected, as shown in FIG. 1, bead 39 of clip 38 engages the bulge 33 on the peripheral barrel surface so that clip 39 can not be hooked into a breast pocket etc. Then when actuator 34 is rotated in the opposite direction, slider piece 21*a* moves backward and the writing tip of ball-point pen element 1*a* retracts into mouthpiece 30*a* while slider piece 21*b* moves forward. At that time, the writing tips are retracted within mouthpiece 30*a* for carriage. In this state, clip 38 is positioned being disengaged from bulge 33 so as to facilitate being hooked into a breast pocket.

A further rotation of actuator 30 moves slider piece 21*a* further backward while moving slider piece 21*b* forward so that the front end of rib 37*a* abuts and engages the rear end of slider piece 21*b* whereby the writing tip of ball-point pen element 1*b* comes out from the front end opening of mouthpiece 30*a*. In this state, bead 39 of clip 38 engages the bulge 33 on the peripheral barrel surface so that clip 38 can not be hooked into a breast pocket etc.

When ball-point pen element 1*a* is placed with point assembly 11 up, ball valve 16 is positioned on a ball seat 8 of valve chamber 7 to seal conduit 9. Therefore, even when, during upward writing, the ink behind tip ball 12 in the point assembly decreases, no backward flow of the ink will occur due to the head. Accordingly, the ink can flow immediately after point assembly 11 is returned downward, thus preventing ink starving during writing (with a configuration having no ball valve, ink flows backward during upward oriented writing so that air is drawn into the point assembly, which leads to ink starving when the pen is returned to the position of downward writing because the ink cannot follow immediately).

In the writing state where point assembly 11 is oriented downward, ball valve 16 abuts the rear end of point assembly 11 and is offset to one side so that an ink channel through which ink can flow into point assembly 11 is assured on the opposite side. Ink 18 which has entered valve chamber 7 from ink reservoir 17 through conduit 9 will be brought to the rear side of tip ball 12.

In this condition, since tip ball 12 is pressed forwards by rod portion 15 so that the ball comes into sealing contact with the inner brim of the ball holder, it is possible to prevent forward leakage of ink. When tip ball 12 is slightly moved backwards by the writing pressure, a gap can be created which allows ink to flow out. As tip ball 12 rotates during writing, ink flows out smoothly without causing any blobbing, thus making it possible to create line traces with thick line density, or enabling correction of mistakes etc. Heretofore, the operation of embodiment 1 was explained but the operation of the other embodiments is basically the same, so that the explanation is omitted.

The configuration and operation of the multiplex writing implement of the invention have been described heretofore. That is, the types of ball-point pen elements can be viewed from outside of the barrel cylinder while it is possible to solve the problem of bad appearance, i.e., the problem of the tip ball and tip-ball holder touching the tapering inner surface of the mouthpiece and hence staining the inner surface with ink when the writing tips move in and out through the front end opening of the mouthpiece. Further, it is possible to avoid the problem, that is, inducement of ink forward leakage and stain of the inner surface and damage of the ball holder causing degradation of writing performance, all attributed to contact of the tip ball and the ball holder of the point assembly with the inner surface. Further, it is possible to provide a multiplex writing implement of which at least one of the ball-point pen elements is a ball-point pen for mistake correction which needs no agitation and is free from the botheration of pressing the container side.

What is claimed is:

1. A multiplex writing implement comprising:

a barrel cylinder;

a mouthpiece extending from a front of the barrel cylinder, the mouthpiece being tapered toward a front end opening thereof;

a plurality of ball-point pen elements disposed within the barrel cylinder, each ball-point pen element having an ink reservoir which is filled with one of a water based ink having thixotropy or a low-viscosity oil based ink, each ball-point pen element being configured so that a writing tip thereof can selectively move in and out through the front end opening of the mouthpiece, each ball-point pen element having a point assembly at one end thereof, at least a front part of the barrel cylinder being formed of a transparent resin molding and the mouthpiece being formed of an opaque material, wherein longitudinal grooves are formed at predetermined positions on the tapering inner surface of the mouthpiece and a ball holder of the point assembly is loosely inserted in the longitudinal groove when the writing tip moves in and out through the front end opening so that at least the ball holder is kept out of contact with the tapering inner surface of the mouthpiece.

2. The multiplex writing implement according to claim 1, wherein each ball-point pen element is configured so that the tip ball is continuously pressed into sealing contact with an inner brim of the ball holder at a top of the point assembly and a follower which is made of a nondrying greasy material is disposed within the ink reservoir at one end of the ink opposite the point assembly, the follower moving following consumption of the ink as writing proceeds.

3. The multiplex writing implement according to claim 1, wherein at least one of the ball-point pen elements is a ball-point pen for mistake correction and the ink is a white pigment ink which includes a white pigment and is formed so that the pigment is prevented from settling.

4. The multiplex writing implement according to claim 3, wherein the white pigment comprises a material selected from the group consisting of titanium oxide and hollow high polymer micro-particles.

5. The multiplex writing implement according to claim 1, wherein each ball-point pen element has a valve chamber in which a ball valve is loosely held therein facing a rear end of the point assembly and a rear part of the valve chamber comprises a ball seat with which the ball valve comes into sealing contact to prevent ink from flowing backward and a conduit communicating between the ball seat and the ink reservoir.

6. The multiplex writing implement according to claim 1, wherein each of the ball-point pen elements is disposed axially movable with respect to the barrel cylinder and a mechanism for moving back and forth the ball-pen elements in an alternating manner is provided, and the ink reservoir of the ball-point pen element is substantially non-deformable and is fitted so as not to sway within the barrel cylinder, and a joint connecting between the ink reservoir and the point assembly is formed with a deformable, flexible part.

7. A multiplex writing implement comprising:

a barrel cylinder;

a mouthpiece extending from a front of the barrel cylinder, the mouthpiece being tapered toward a front end opening thereof;

a plurality of ball-point pen elements disposed within the barrel cylinder, each ball-point pen element having an ink reservoir which is filled with one of a water based ink having thixotropy or a low-viscosity oil based ink, each ball-point pen element being configured so that a writing tip thereof can selectively move in and out through the front end opening of the mouthpiece, each ball-point pen element having a point assembly at one end thereof, at least a front part of the barrel cylinder being formed of a transparent resin molding and the mouthpiece being formed of an opaque material, wherein a joint for joining the ink reservoir and the point assembly has a projection on a peripheral surface thereof which comes in contact with the tapering inner surface of the mouthpiece in such a manner that a ball holder of the point assembly is kept out of contact with the tapering inner surface of the mouthpiece when the writing tip moves in and out through the front end opening of the mouthpiece.

8. The multiplex writing implement according to claim 7, wherein each ball-point pen element is configured so that the tip ball is continuously pressed into sealing contact with an inner brim of the ball holder at a top of the point assembly and a follower which is made of a nondrying greasy material is disposed within the ink reservoir at one end of the ink opposite the point assembly, the follower moving following consumption of the ink as writing proceeds.

9. The multiplex writing implement according to claim 7, wherein at least one of the ball-point pen elements is a ball-point pen for mistake correction and the ink is a white pigment ink which includes a white pigment and is formed so that the pigment is prevented from settling.

10. The multiplex writing implement according to claim 9, wherein the white pigment comprises a material selected from the group consisting of titanium oxide and hollow high polymer micro-particles.

11. The multiplex writing implement according to claim 7, wherein each ball-point pen element has a valve chamber in which a ball valve is loosely held therein facing a rear end of the point assembly and a rear part of the valve chamber comprises a ball seat with which the ball valve comes into sealing contact to prevent ink from flowing backward and a conduit communicating between the ball seat and the ink reservoir.

12. The multiplex writing implement according to claim 7, wherein each of the ball-point pen elements is disposed axially movable with respect to the barrel cylinder and a mechanism for moving back and forth the ball-pen elements in an alternating manner is provided, and the ink reservoir of the ball-point pen element is substantially non-deformable and is fitted so as not to sway within the barrel cylinder, and a joint connecting between the ink reservoir and a point assembly is formed with a deformable, flexible part.

13. The multiplex writing implement according to claimed 7, wherein the joint has a flexible portion, and the projection is provided to the point assembly side with respect to the flexible portion.

* * * * *

UNITED STATES PATENT AND TRADEMARK OFFICE

CERTIFICATE OF CORRECTION

PATENT NO. : 6,217,241 B1
DATED : April 17, 2001
INVENTOR(S) : Seiichi Kobayashi It is certified that error appears in the above-identified patent and that said Letters Patent is hereby corrected as shown below:

Title page,
Item [75] Inventor, change "Yokohama (JP)" to -- Kanagawa, (JP) --.

Signed and Sealed this

Twenty-ninth Day of January, 2002

*Attest:*

*Attesting Officer*

JAMES E. ROGAN
*Director of the United States Patent and Trademark Office*